US006397529B1

(12) United States Patent
Grenier

(10) Patent No.: US 6,397,529 B1
(45) Date of Patent: Jun. 4, 2002

(54) ADJUSTABLE MODULAR STAIRCASE

(76) Inventor: Gilles Grenier, 586, ave Texel, St-Elzéar P.Q. (CA), G6G 5R6

( * ) Notice: Subject to any disclaimer, the term of this patent is extended or adjusted under 35 U.S.C. 154(b) by 0 days.

(21) Appl. No.: 09/501,142

(22) Filed: Feb. 9, 2000

(51) Int. Cl.[7] ..... E04F 11/00

(52) U.S. Cl. ..... 52/182; 52/184; 52/188; 52/190; 52/191

(58) Field of Search ..... 52/182, 183, 184, 52/188, 190, 191

(56) References Cited

U.S. PATENT DOCUMENTS

| | | | | | |
|---|---|---|---|---|---|
| 4,783,939 | A | * | 11/1988 | Bergmann et al. | 52/188 |
| 5,502,933 | A | | 4/1996 | Skillern | |
| 5,636,483 | A | * | 6/1997 | Wille | 52/188 |
| 5,660,009 | A | * | 8/1997 | Cousin | 52/183 |
| 5,720,136 | A | | 2/1998 | Turner | |
| 5,791,101 | A | * | 8/1998 | Wallace | 52/191 |
| 5,899,032 | A | | 5/1999 | Buzby | |
| 5,907,935 | A | | 6/1999 | Elena | |
| 6,067,758 | A | * | 5/2000 | Zenkner | 52/182 |
| 6,125,598 | A | * | 10/2000 | Lanphier | 52/182 |
| 6,173,540 | B1 | * | 1/2001 | Spivey | 52/191 |

FOREIGN PATENT DOCUMENTS

| | | | |
|---|---|---|---|
| NZ | 2110737 | * | 6/1983 |

* cited by examiner

*Primary Examiner*—Carl D. Friedman
*Assistant Examiner*—Jennifer I. Thissell

(57) ABSTRACT

The adjustable modular staircase includes two stringers for rigid attachment to a building structure in parallel, opposed relationship to each other, a plurality of axially parallel pins protrude out of each of the stringers and are spaced equidistant apart there along, the pins in one stringer are axially aligned with the pins in the other stringer when installed in the building structure, and a plurality of step modules, each including a tread and at least one end wall. The end wall has a top edge for supporting one end of the tread, a bottom edge inclined with respect to the top edge, and a notch in the bottom edge for releasably pivotally engaging one of the pins, whereby the step module can pivot around the pin to allow for horizontal leveling of each of the treads so as to form a rough staircase used for the early stages of the building process. Each step module preferably includes a riser having an end supported by a front edge of the end wall. Finally, at the end of the building process, a plurality of finishing plates are fixedly attached onto the treads, risers, end walls and to the building structure to provide a proper surface finish of the staircase.

12 Claims, 7 Drawing Sheets

ADJUSTABLE MODULAR STAIRCASE

FIELD OF THE INVENTION

The present invention relates to staircases and more specifically to the construction of adjustable modular staircases using step modules with respect to its overall rise and run.

BACKGROUND OF THE INVENTION

It is well known in the art to have adjustable staircases. Yet, most of these adjustable staircases are only partially adjustable since they allow for a choice of two different staircase runs for a fixed staircase rise as described in U.S. Pat. No. 5,636,483 granted to Wille on Jun. 10, 1997. Another adjustable staircase provides only for a modular step rise adjustment with a fixed step run, thereby providing again two or three possible overall staircase runs for a fixed staircase rise as described in U.S. Pat. No. 5,502,933 granted to Skillern on Apr. 2, 1996 and U.S. Pat. No. 5,899,032 granted to Buzby on May 4, 1999; as long as the step rise remains within allowable limits dictated by various local building codes.

In order to have the flexibility to set the exact staircase run desired, within building code limits, for a fixed staircase rise, one must consider expensive and complicated staircase systems which may be neither affordable nor available for many average size house buildings.

It is also known to have partially prefabricated staircases that are finally assembled on the building yard site in order to ensure precise fitting of the staircase with the stairwell. Thus avoiding the extra cost associated to the risk of possible non-fitting of the entire prefabricated staircase with the stairwell, not even accounting for problems and cost encountered with the transportation of such large prefabricated staircase pieces.

Furthermore, with all known adjustable staircases of today, the treads are always positioned inwardly of the two stringers and forcing the final stairwell to have either full or short open (formed by the stringers themselves) walls on each side of the staircase, as opposed to completely open wall configuration.

OBJECTS OF THE INVENTION

It is therefore a general object of the present invention to provide an adjustable modular staircase of the character described which obviates the above noted disadvantages.

Another object of the present invention is to provide an adjustable modular staircase that allows for the selection of any staircase run, within building code limits, for a given staircase rise and vice versa.

Another object of the present invention is to provide an adjustable staircase that allows for the assembly of the staircase on site at the early stage of the building with rough tread surfaces that are covered by a proper surface finish later on in the building process.

A further object of the present invention is to provide an adjustable staircase that can be assembled in such a way that each side of the staircase is independently mounted either inwardly or outwardly of its stringer depending on the stairwell configuration within the building.

Another object of the present invention is to provide an adjustable modular staircase that reduces the complexity, the cost of the assembling of the staircase due to a reduced an amount of pieces added to prefabricated step modules provided in a wide variety of standard widths.

SUMMARY OF THE INVENTION

The present invention is directed to a modular staircase comprising:

- two stringers for rigid attachment to a building structure in parallel, opposed relationship to each other;
- a plurality of axially parallel pins protruding out of each of said stringers and spaced equidistant apart along said stringers, the pins in one stringer being axially aligned with the pins in the other stringer when installed in a building structure; and
- a plurality of step modules, each step module including a tread and at least one end wall, said end wall having a top edge for supporting one end of the tread, a bottom edge inclined with respect to said top edge, and a notch in said bottom edge for releasably pivotally engaging one of said pins, whereby the step module can pivot around said pin to allow for horizontal leveling of each of the treads.

Preferably, each of said step modules includes a riser, said end wall supporting an end of said riser on a front edge thereof.

Preferably, each of said step modules includes horizontal supports extending rearwardly from a :bottom surface of said tread and vertical supports extending downwardly from a rear surface of said riser, when installed in a building structure, said horizontal supports of one step module abut the vertical supports of an upper, adjacent step module and said vertical supports of said one step module abut the horizontal supports of a lower adjacent step module, whereby said one step module is secured to said upper and lower adjacent modules by interconnecting said horizontal and vertical supports to vertical and horizontal supports of said upper and lower adjacent step modules, respectively.

Preferably, the staircase includes inclined holes in ends of said tread for securing said step module to a building structure, Preferably, the staircase includes finishing plates for attachment to said tread, riser and end wall of each said step module to provide surface finish to said staircase.

Preferably, the finishing plate for said tread includes a convex tip for covering exposed edges of said tread, and a horizontal groove in an inner surface of said tip for engagement by a front edge of a tread to better secure said finishing plate of said tread.

Preferably, the tread finishing plate includes a thin layer of rigid material bonded up-side-down to a bottom surface of a finish material, thereby ensuring that said tread finishing plate has a slightly concave shape for better installation on said tread.

Preferably, the staircase, when installed in a building structure, the pins of one stringer extend toward the pins of the other stringer, whereby step modules can be mounted between stringers.

Alternatively, the staircase, when installed in a building structure, the pins of one stringer extend away from the pins of the other stringer, whereby said step modules overlap said stringers when installed.

Alternatively, the staircase, when installed in a building structure, all pins of said stringers extend in the same direction, whereby one end of each stop module is mounted inside of one stringer and the other end of each step module overlaps the other stringer.

Also, the present invention is directed to a staircase finishing kit for renovating the finishing of a step of an existing staircase, the kit comprises finishing plates for attachment to a tread, exposed end walls and a riser of said step to provide surface finish of the step, said finishing plate for said tread includes a convex tip for covering exposed edges of said tread, and a horizontal groove in an inner surface of said tip for engagement by a front edge of a tread to better secure said finishing plate of said tread.

BRIEF DESCRIPTION OF THE DRAWINGS

In the annexed drawings, like reference characters indicate like elements throughout.

FIG. 2*a* is a perspective view of the assembled frame structure of FIG. 2 showing both a closed wall (right hand side) and an open wall (left hand side) configurations respectively;

DETAILED DESCRIPTION OF THE PREFERRED EMBODIMENTS

Figure 1:
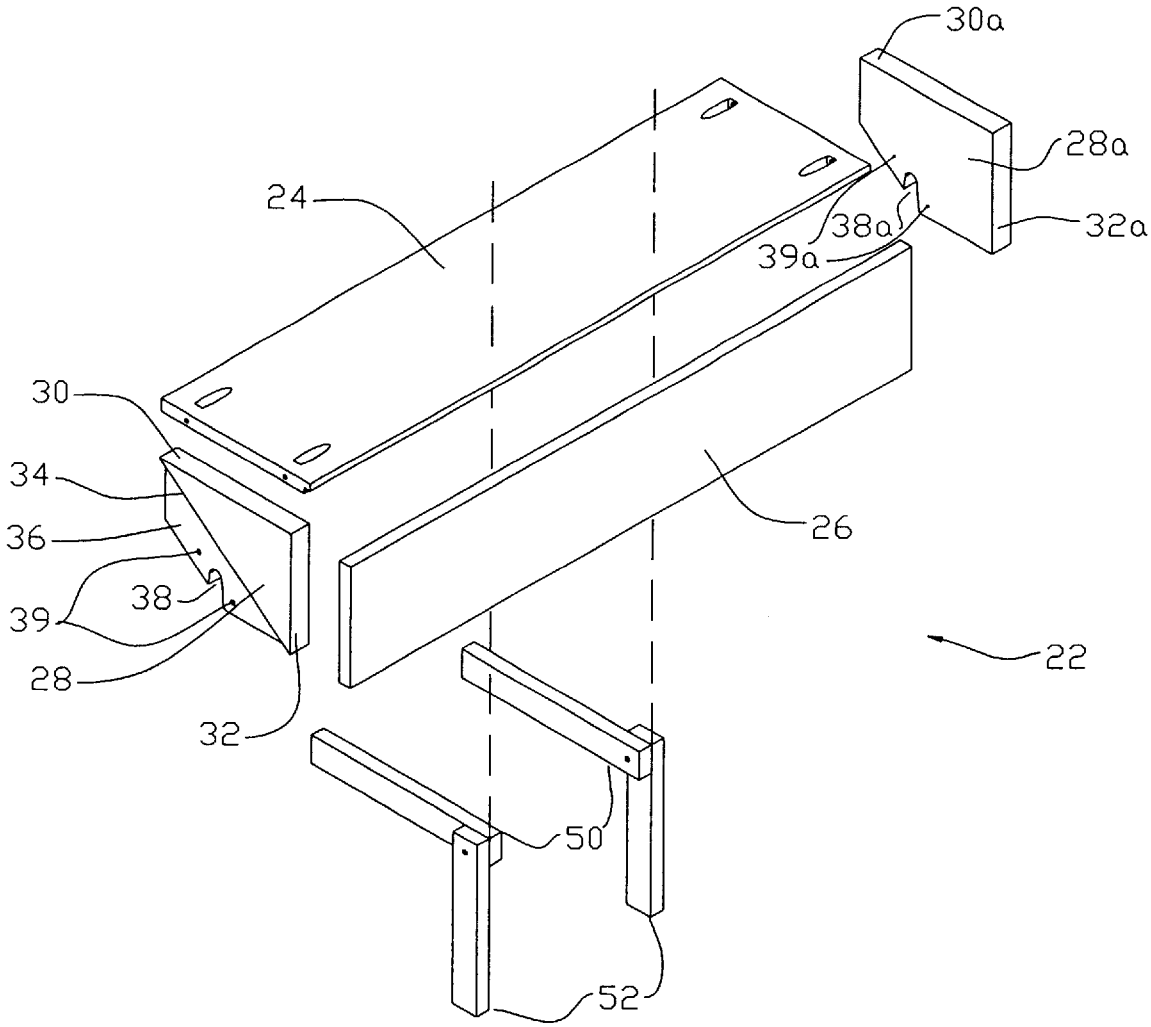
FIG. 1 is an exploded perspective view of an embodiment of a step module according to an adjustable staircase according to the present invention.
Figure 2:
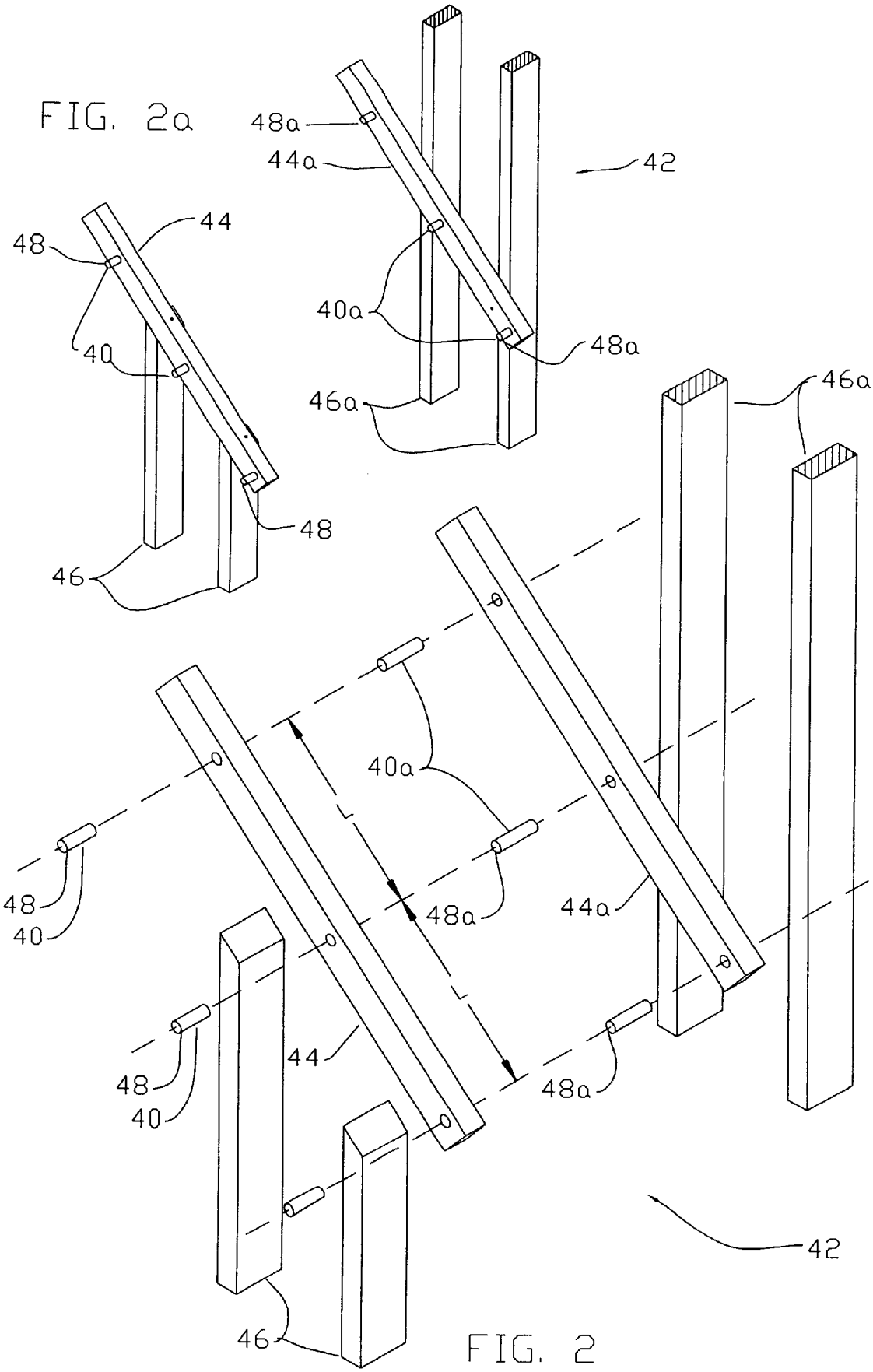
FIG. 2 is a exploded perspective view of an embodiment of a frame structure with stringers for receiving the step modules of FIG. 1.
Figure 3:
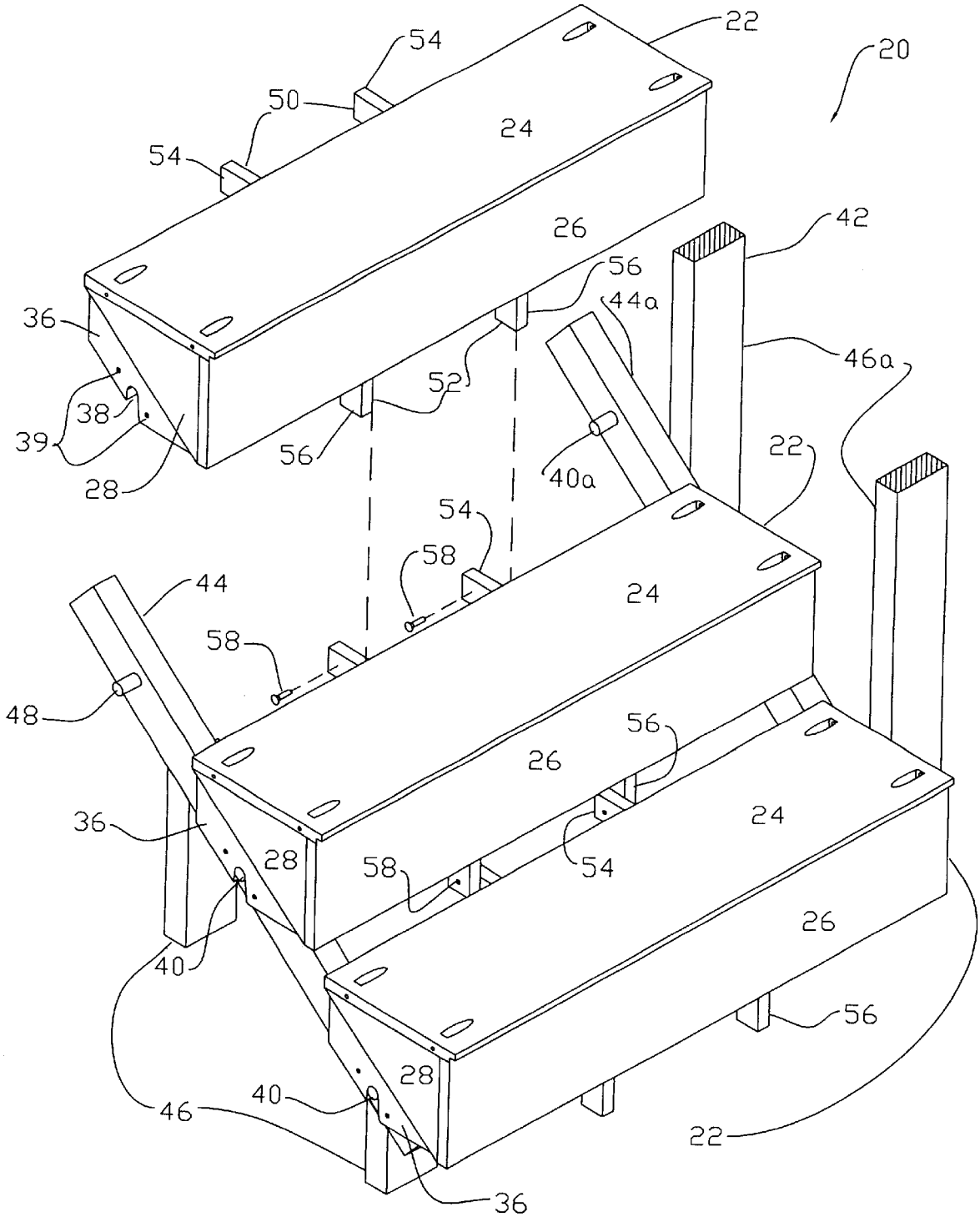
FIG. 3 is a partially exploded perspective view of step modules of FIG. 1 mounted on the frame structure of FIG. 2 showing a staircase with a rough surface finish.

Referring to FIGS. 1 to 3, a plurality of prefabricated step modules 22 are assembled together on site so as to form an adjustable modular staircase 20 according to the present invention. Each step module 22 preferably includes a horizontal rectangular tread 24 attached to a vertical riser 28 (which, as an option, could be absent) via a pair of right angle end sections 28, 28*a* essentially symmetrical to each other and located at the two width extremities of the step module 22. The tread 24 and the riser 26 are respectively mounted on the top 30, 30*a* and side 32, 32*a* edges of the end sections 28, 28*a* forming the right angle. The closing hypotenuse edge 34, 34*a* is provided with a protruding portion 36, 36*a*, preferably inwardly recessed for better finishing capabilities as explained below, adapted with an essentially downwardly oriented notch 38, 38*a* to pivotally engage pivot pins 40, 40*a* respectively. An essentially horizontal bore hole 39, 39*a* is located on each side of the notch 38, 38*a* to permanently block the step module 22 from any pivoting movement around the pins 40, 40*a*. The blocking of the step module 22, preferably using screws or the like, is performed to permanently secure the tread 24 in an essentially horizontally leveled position.

The step modules 22 are individually mounted onto the staircase frame structure 42 or building structure installed on site at the building yard to allow for a proper adjustment of the desired inclination of the staircase 20. As shown in FIGS. 2 and 2*a*, the frame structure 42 includes two opposite and parallel stringers 44, 44*a*, preferably of rectangular cross-section, rigidly secured to the timbers 46, 46*a* of the stairwell, and a plurality of pivot pins 40, 40*a* protruding out of each of the stringers 44, 44*a* and spaced equidistant apart along the same with intervals L to determine two parallel lines. Preferably, the pins 40, 40*a* are longer than the thickness of the stringers 44, 44*a* in order to ensure their protrusion therefrom. When partially inserted into the stringers 44, 44*a*, the pins 40, 40*a* present protruding extremities 48, 48*a* with parallel horizontal axes. Each pin 40 of one of the stringers 44 has a corresponding pin 40*a* on the other stringers 44*a* so as to form of pair of co-linear pins. It is obvious that each pin 40, 40*a* is very accurately positioned on its strangers 44, 44*a*. Accordingly, the protruding extremities 48, 48*a* of each pair of pins 40, 400 are adapted to be pivotally engaged by the notches 38, 38*a* of the step module 22. The protruding extremities 48, 48*a* of the pins 40, 40*a* are all located on the sa side of their stringer 44, 44*a* respectively.

Depending on the final configuration of the stairwell, the stringers 44, 44*a* are either secured to the side or top and the timbers 46, 46*a* to obtain a closed or open wall for the staircase 20 respectively; both wall configurations are shown in FIGS. 2 to 5. The inclination angle of the stringers 44, 44*a* is determined, either by calculation or using a table, depending on the selected number of the stair steps based on the given staircase rise (the floor to floor vertical distance). In such a case, because of local building codes on the allowable step rise and run of the building staircase, the selected angle of inclination will have to be anywhere within two limits. The interval L between two adjacent pins 40, 40*a* is then obtained depending on that selected angle.

The pins 40*a* inwardly protrude from the stringer 44*a* when the latter is secured to a closed wall. On the other hand, when there is an open wall configuration, the pins 40 are preferably outwardly protruding from the stringer 44 to ensure a close fit with the open wall, again for better finishing capabilities of the staircase 20 within the stairwell.

In order to improve the overall rigidity of the staircase 20, each of the prefabricated step modules 22 preferably includes two additional horizontal support members 50 secured to the bottom surface of the tread 24 and rearwardly extending therefrom, and two additional vertical support members 52 secured to the rear surface of the riser 26 and downwardly extending therefrom. The horizontal members 50 are properly positioned to have their rear extensions 54 essentially tightly abutting the lower extensions 56 of the vertical members 52 of the next upper adjacent step module 22 when both step modules are secured to both stringers 44, 44*a*. Accordingly, an attachment devices, preferably screws 58 or the like, are therefore used to secure the extensions 54, 56 of one step module 22 to its respective abutting extensions 56, 54 of the adjacent step module 22.

As seen in FIG. 3, both the run of the rise of all individual step modules 22 are similar and specifically made to be at essentially the minimum limits allowed by the building codes. Consequently, in most staircases 20, a small gap is created between two adjacent step modules 22 due to the selected interval L between two adjacent pins 40. At this stage of assembly, the staircase 20 presents rough tread surfaces, preferably made out of softwood, plywood or particleboard, and is of proper use for the early phases of the building process, as a so-called "temporary" staircase, until the finishing is installed thereon. The step modules 22 are preferably prefabricated at the production plant and are available in a wide variety of fixed widths that are the most commonly used in staircase construction. The pins 40, 40*a* and the stringers 44, 44*a* are preferably made out of hardwood, but any other rigid and resistant material may also be used.

Figure 4:
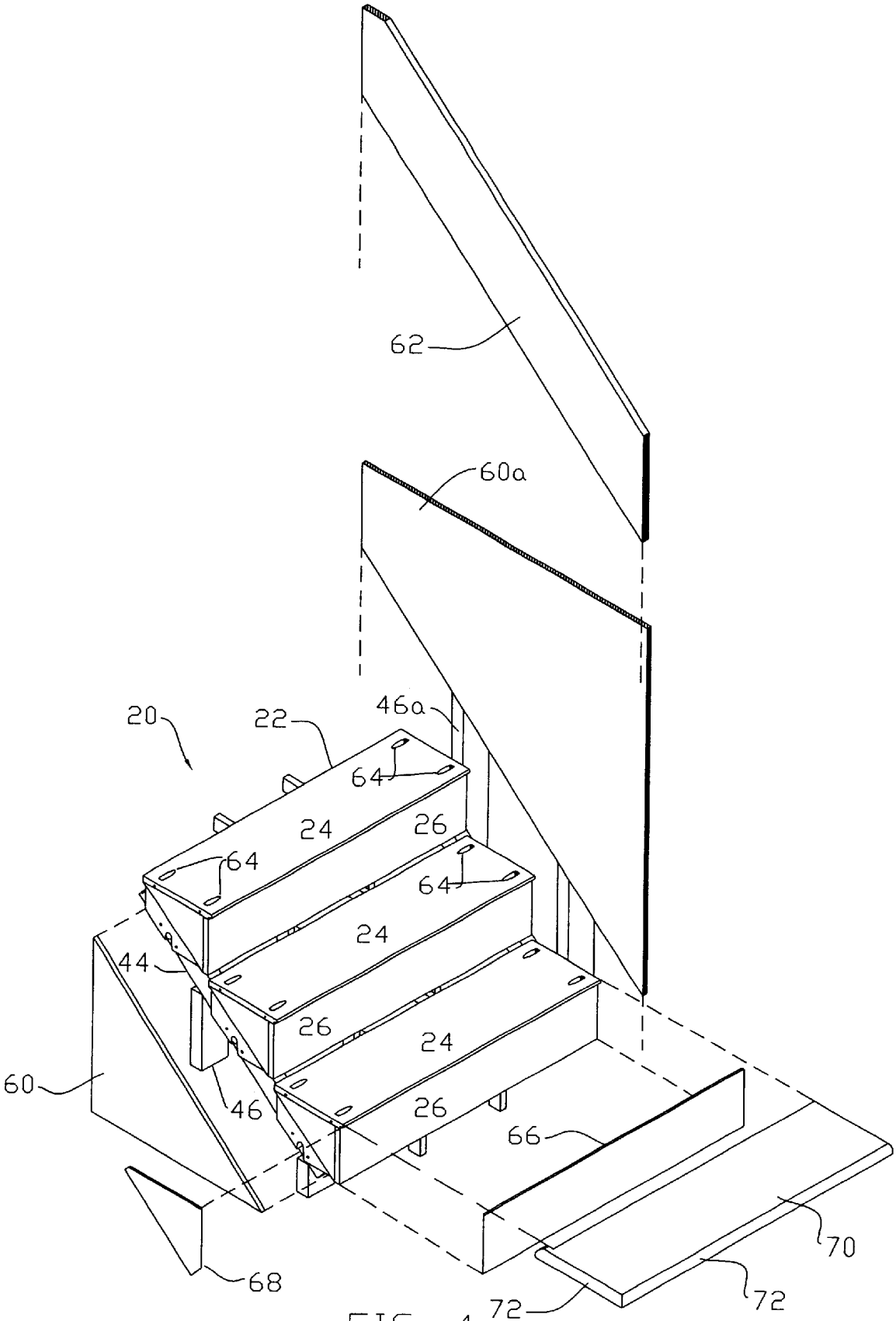
FIG. 4 is an exploded perspective view showing the stairwell wall finishing and a step module finishing plates.
Figure 5:
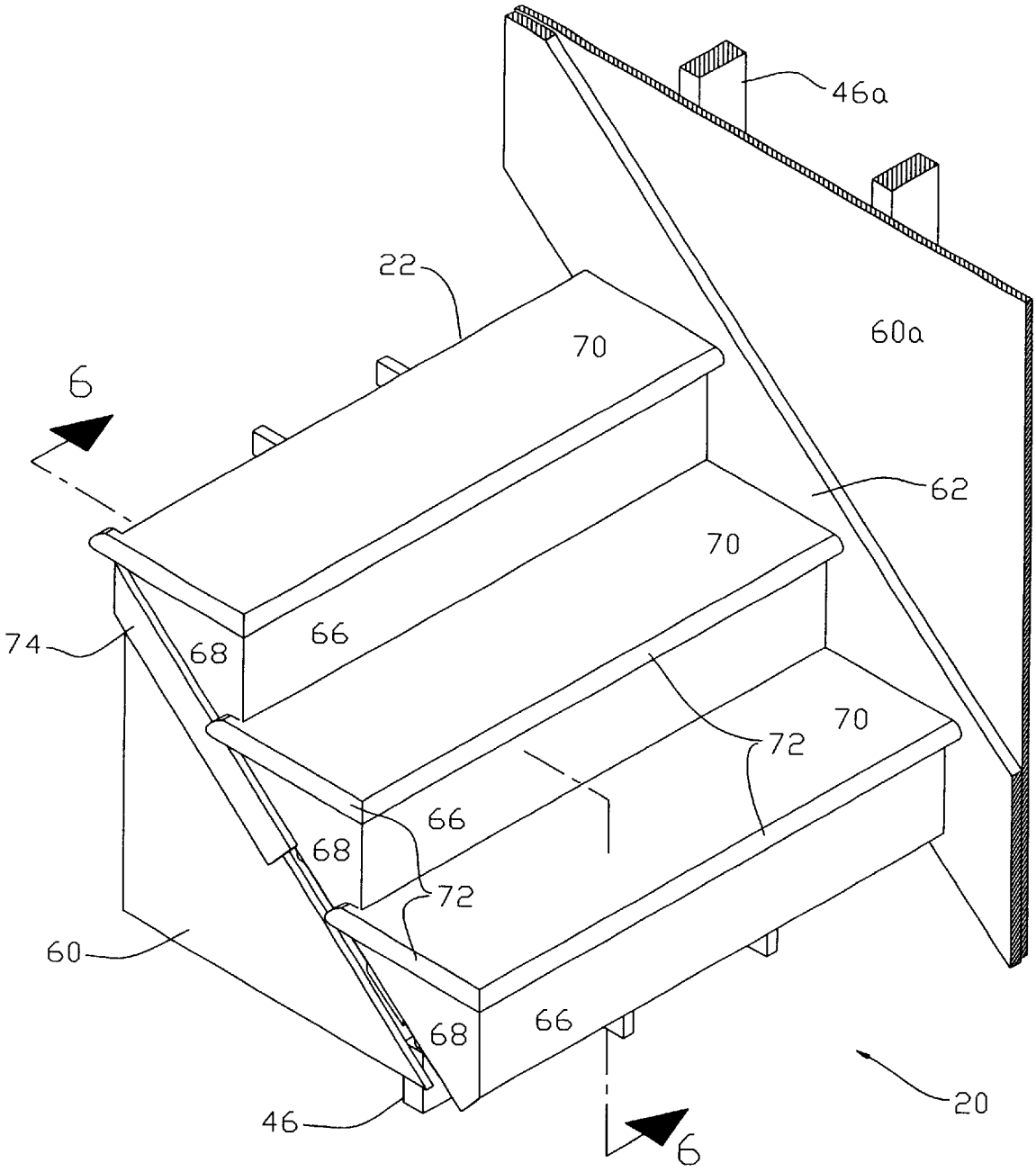
FIG. 5 is a perspective view of the embodiment of FIG. 4 shown in an almost completed finished up staircase.

As depicted on FIGS. 4 and 5, after the step modules 22 have been installed on the frame structure 42, the final covering up and finishing operations can take place by first installing the wall structure of the stairwell. Preferably, plasterboards 60, 60*a* (also called drywalls) are installed to cover the timbers 46, 46*a* down to the stringers 44, 44*a* followed by a dummy stringer 62 of the proper thickness inserted between the plasterboard 60*a* of the closed wall and the step modules 22. In such a closed wall configuration, the tread 24 of the step module 22 is provided with essentially slanted screw access blind holes 64 at the width extremity to properly secured the dummy stringer 62 against each step module 22. By default, the blind holes 64 are preferably provided on both extremities of the tread 24 and are therefore used whenever required.

Figure 6:
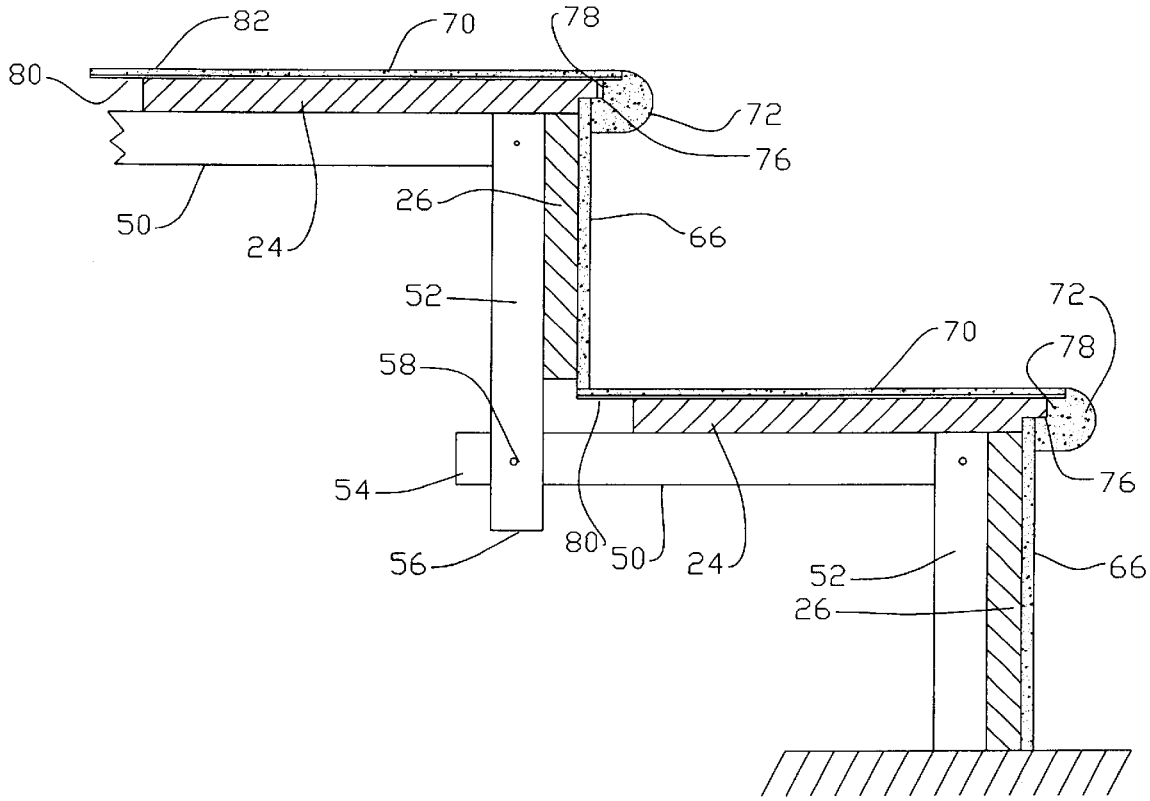
FIG. 6 is a partial section view of the two lowermost steps taken along line 6—6 of FIG. 5.
Figure 7:
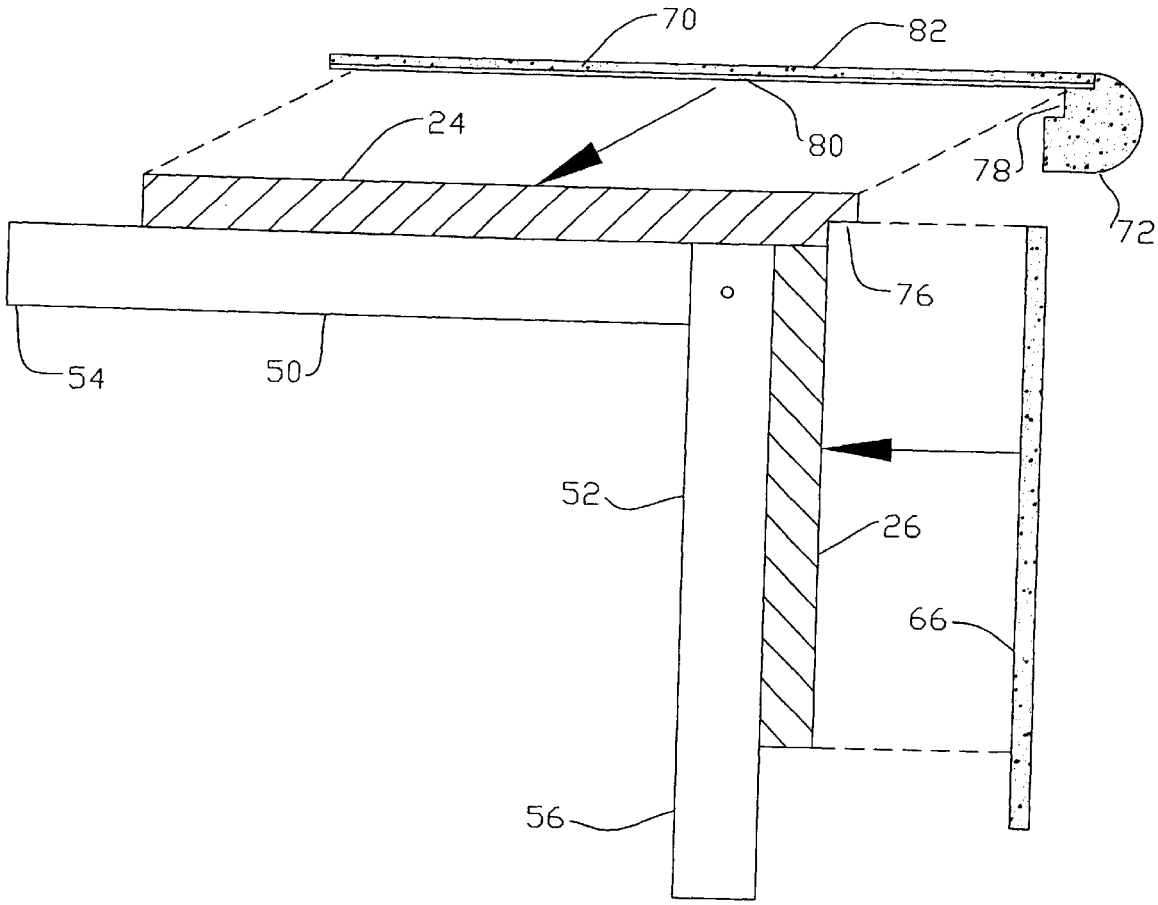
FIG. 7 is an enlarged exploded section view of the upper step of FIG. 6.

Then, the covering up and finishing of the step modules 22 is performed starting by the lowermost one. A riser finishing plate 66 is first attached to the riser 26 preferably using appropriate glue, screws or the like, followed by a small stringer finishing plate 68 to close off the end section 28 of the step module 22 left uncovered by the open wall configuration. Finally, a tread finishing plate 70 is installed to dose off the blind holes 64 and provide a proper surface finish to match the surrounding decor of the stairwell. Especially when a hardwood finish is considered, the exposed edges of the tread finishing plate 70 are essentially terminated by a downwardly incurved protruding rounded tips 72 that also cover the top edges of their respective lower riser finishing plate 66 or stringer finishing plate 68. Additionally, the rear edge of the tread finishing plate 70 is covered by the riser finishing plate 66 of the upper adjacent step module 22 abutting the same, as shown in FIG. 6.

The same finishing sequence is therefore used for all the step modules 22 up to the uppermost one. It is obvious that the step modules 22 could be covered by carpet or the like type of surface finish, with different finishing pieces if required. Finally, to close off some remaining gaps between the plasterboard 60 and the different stringer finishing plates 68, proper finishing moldings 74 may be used as shown in FIG. 5.

In order to improve the attachment of the riser finishing plate 66 and the tread finishing plate 70 and the exposed front edge of the tread 24, the latter is preferably provided with the protruding lips 76 extending all along the exposed front edge. Accordingly, the top edge of the lower riser finishing plate 66 totally abuts against the bottom of the lips 76 that frontwardly protrudes further beyond the same. The inside of the protruding tip 72 is provided with an internal groove 78 extending all along the same and adapted to receive the further protrusion of the lip 76. All of the above-mentioned attachments are preferably provided via proper glue or screws (not shown).

Preferably, the tread finishing plate 70 includes a thin internal layer 80 made out of veneer material or the like rigid material and bonded up-side-down to the underneath of the exposed layer 82 of hardwood material so as to ensure a slight upwardly concave shape of the same prior to the installation for better uniform surface contact with the tread 24 surface once installed thereon. The veneer layer 80 is essentially thinner than the exposed hardwood layer 82 to retain the latter from forming a somewhat significant upwardly concave shape of the latter.

Furthermore, the above described finishing plates 70, 68 and 66 for the tread 24, the riser 26 and the end sections 28, 28*a* are adapted for use on existing staircases when the latter need some renovation. Accordingly, the finishing plates are available in various fixed dimensions that can be tailored on site, whenever required.

Although an embodiment has been described herein with some particularity and details, many modifications and variations of the preferred embodiment are possible without deviating from the scope of the present invention.

I claim:

1. A modular staircase comprising:

two stringers for rigid attachment to a building structure in parallel, opposed relationship to each other;

a plurality of axially parallel pins protruding out of each of said stringers and spaced equidistant apart along said stringers, the pins in one stringer being axially aligned with the pins in the other stringer when installed in a building structure; and a plurality of step modules, each step module including a tread and at least one end wall, said end wall having a top edge for supporting one end of the tread, a bottom edge inclined with respect to said top edge, and a notch in said bottom edge for releasably pivotally engaging one of said pins, whereby the stop module can pivot around said pin to allow for horizontal leveling of each of the treads.

2. The staircase of claim 1, wherein each of said step modules includes a riser, said end wall supporting an end of said riser on a front edge thereof.

3. The staircase of claim 2, wherein each of said step modules includes horizontal supports extending rearwardly from a bottom surface of said tread and vertical supports extending downwardly from a rear surface of said riser, when installed in a building structure, said horizontal supports of one step module abut the vertical supports of an upper, adjacent step module and said vertical supports of said one step module abut the horizontal supports of a lower adjacent step module, whereby said one step module is secured to said upper and lower adjacent modules by interconnecting said horizontal and vertical supports to vertical and horizontal supports of said upper and lower adjacent step modules, respectively.

4. The staircase of claim 1, including inclined holes in ends of said tread for securing said step module to a building structure.

5. The staircase of claim 1, including finishing plates for attachment to each said tread and end wall of said step modules to provide surface finish to said staircase.

6. The staircase of claim 2, including finishing plates for attachment to said tread, riser and end wall of each said stop module to provide surface finish to said staircase.

7. The staircase of claim 6, wherein the finishing plate for said tread includes a convex tip for covering exposed edges of said tread, and a horizontal groove in an inner surface of said tip for engagement by a front edge of a tread to better secure said finishing plate of said tread.

8. The staircase of claim 6, wherein said tread finishing plate includes a thin layer of rigid material bonded up-side-down to a bottom surface of a finish material, thereby ensuring that said tread finishing plate has a slightly concave shape for better installation on said tread.

9. The staircase of claim 1, wherein, when installed in a building structure, the pins of one stringer extend toward the pins of the other stringer, whereby step modules can be mounted between stringers.

10. The staircase of claim 1, wherein, when installed in a building structure, the pins of one stringer extend away from the pins of the other stringer, whereby said step modules overlap said stringers when installed.

11. The staircase of claim 1, wherein, when installed in a building structure, all pins of said stringers extend in the same direction, whereby one end of each step module is mounted inside of one stringer and the other end of each step module overlaps the other stinger.

12. A staircase finishing kit for renovating the finishing of a step of an existing staircase, said kit comprising finishing plates for attachment to a tread, exposed end walls and a riser of said stop to provide surface finish of the step, said finishing plate for said tread includes a convex tip for covering exposed edges of said tread, and a horizontal groove in an inner surface of said tip for engagement by a front edge of a tread to better secure said finishing plate of said tread, said tread finishing plate includes a thin layer of rigid material bonded up-side-down to a bottom surface of a finishing material, thereby ensuring that said tread finishing plate has a slightly concave shape for better installation an the tread of said step.

* * * * *